United States Patent [19]

Carter

[11] Patent Number: 4,866,923

[45] Date of Patent: Sep. 19, 1989

[54] TRAVELLER HAVING INNER YARN GUIDE PATH WITH NO MOLD PARTING LINE

[75] Inventor: Calvin E. Carter, Seneca, S.C.

[73] Assignee: Coats & Clark Inc., Greenville, S.C.

[21] Appl. No.: 237,154

[22] Filed: Aug. 26, 1988

[51] Int. Cl.[4] ..... D01H 7/60

[52] U.S. Cl. ..... 57/125; 425/542

[58] Field of Search ..... 57/119, 125; 425/542, 425/DIG. 247

[56] References Cited

U.S. PATENT DOCUMENTS

| | | | |
|---|---|---|---|
| 2,326,828 | 8/1943 | Camp | 57/125 |
| 2,572,140 | 10/1951 | Haley | 57/125 |
| 2,918,780 | 12/1959 | Bowen | 57/125 |
| 2,999,276 | 9/1961 | Morin | 57/125 X |
| 3,134,219 | 5/1964 | Carter et al. | 57/125 |

*Primary Examiner*—Donald Watkins

*Attorney, Agent, or Firm*—Burgess, Ryan & Wayne

[57] ABSTRACT

A traveller for use in a textile spinning and twisting machine, includes a substantially C-shaped member adapted to engage and travel about a ring of the machine, the member having an outer surface and an inner surface constituting a yarn guide path on which yarn travels, the yarn guide path on the inner surface being free of any mold parting line, the traveller being formed in a mold and the yarn guide path on the inner surface being formed by a groove in an ejector pin of the mold.

5 Claims, 5 Drawing Sheets

FIG. 3
PRIOR ART
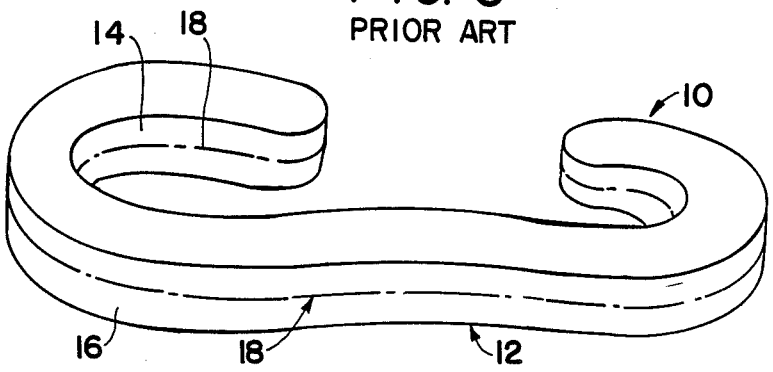
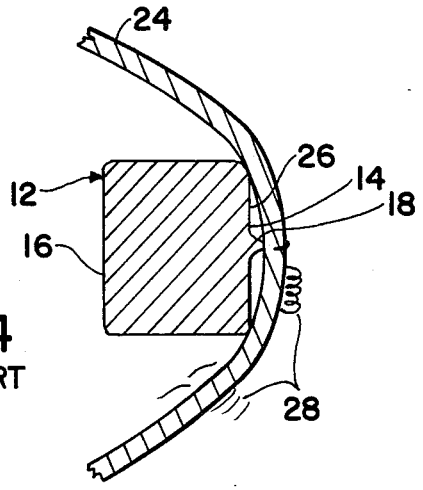
FIG. 4
PRIOR ART

TRAVELLER HAVING INNER YARN GUIDE PATH WITH NO MOLD PARTING LINE

BACKGROUND OF THE INVENTION

This invention relates generally to travellers which are used on spinning and twisting frames in the textile industry.

The use of travellers in the textile industry, and particularly with textile spinning and twisting machines, is well known in the art. Such travellers have a substantially C shape and engage and slide about a ring of the aforementioned textile spinning and twisting machines. The ring is conventionally in surrounding relation to a bobbin which carries yarn thereabout. Thus, the yarn extends from the bobbin and around a portion of the inner surface of the C-shaped traveller, as the traveller rotates about the ring. Specifically, the inner portion of the traveller about which the yarn rides and is guided, is denoted as the yarn guide path.

However, conventional travellers have a mold parting line along their inner and outer surfaces, including the yarn guide path. Such a parting line presents a raised, sharp line about which the yarn must thereby travel. As a result, such a parting line or flash tends to cause an undesirable breaking or fuzzing up of the yarn as the yarn travels thereover.

OBJECTS AND SUMMARY OF THE INVENTION

Accordingly, it is an object of the present invention to provide a traveller which overcomes the aforementioned problems encountered with the prior art.

It is another object of the present invention to provide a traveller in which the yarn guide path at the inner surface thereof is free of any mold parting line or flash.

It is still another object of the present invention to provide a traveller in which the yarn guide path at the inner surface presents a smooth surface for yarn travel.

It is yet another object of the present invention to provide a mold for forming such a traveller.

It is a further object of the present invention to provide a mold having an ejector pin which is used both to form a smooth yarn guide path of the traveller at the inner surface thereof and to eject the formed traveller from the mold.

It is a still further object of the present invention to provide a traveller and mold that are relatively easy and economical to manufacture and use.

In accordance with an aspect of the present invention, a traveller for use in a textile spinning and twisting machine includes a substantially C-shaped member adapted to engage and travel about a ring of the machine, said member having an outer surface and an inner surface, a portion of said inner surface constituting a yarn guide path on which yarn travels and wherein said yarn guide path on said inner surface is free of any mold parting line.

In accordance with another aspect of the present invention, there is formed a mold for forming a traveller for use in a textile spinning and twisting machine, the traveller having an inner surface and a portion of the inner surface constituting a yarn guide path on which yarn travels, including a first mold half having a first recess, a second mold half having a second recess; a mold cavity formed by the first and second recesses when the first and second mold halves are assembled together, the cavity having a substantially C-shape to form the traveller therein; and ejector means for forming the yarn guide path free of any parting line and for ejecting the traveller from the mold after the first and second mold halves have been opened.

The above and other objects, features and advantages of the present invention will become readily apparent from the following detailed description thereof which is to be read in connection with the accompanying drawings.

BRIEF DESCRIPTION OF THE DRAWINGS

FIG. 3 is a perspective view of the traveller of FIG. 1, from a different view;

FIG. 4 is a cross-sectional view of the traveller of FIG. 1, showing the effects of the mold parting line of the yarn guide path on yarn passing thereover;

DETAILED DESCRIPTION OF THE PREFERRED EMBODIMENTS

Figure 1:
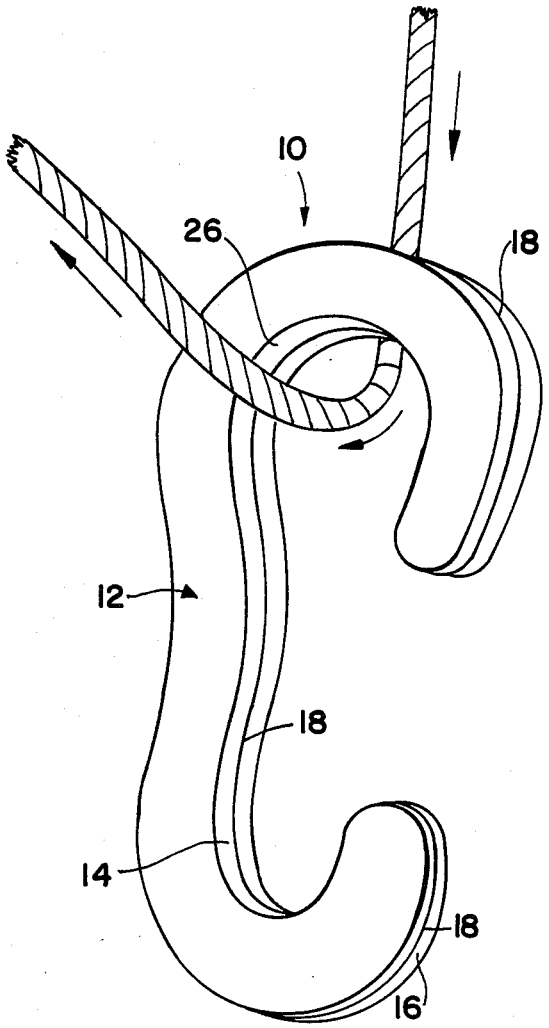
FIG. 1 PRIOR ART
FIG. 1 is a perspective view of a traveller according to the prior art, shown with yarn travelling therearound.

Referring to the drawings in detail, and initially to FIGS. 1—4, a traveller 10 according to the prior art is formed by a substantially C-shaped member 12 made of a suitable plastic material. C-shaped member 12 has an inner planar surface 14 and an outer planar surface 16. As clearly shown in FIGS. 1, 3 and 4, inner surface 14 and outer surface 16 are each formed with a mold parting line 18 extending longitudinally and centrally of the inner and outer surfaces 14 and 16.

Figure 2:
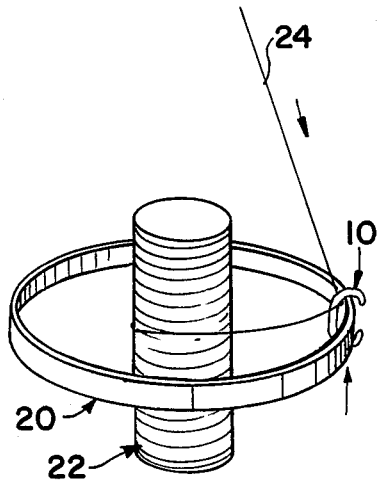
FIG. 2 PRIOR ART
FIG. 2 is a perspective view of a portion of a textile spinning and twisting machine with which the traveller of FIG. 1 is used according to the prior art.
Figure 5:
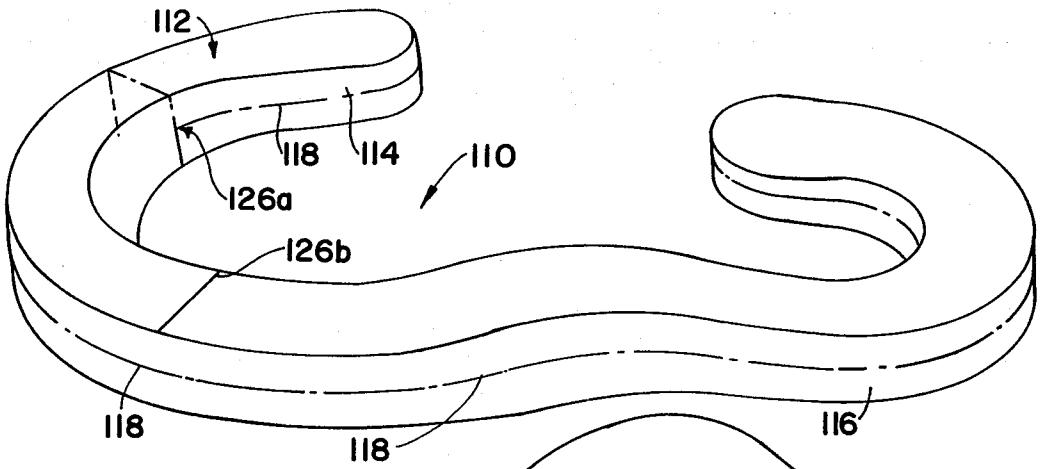
FIG. 5 is a perspective view of a traveller according to the present invention.
Figure 6:
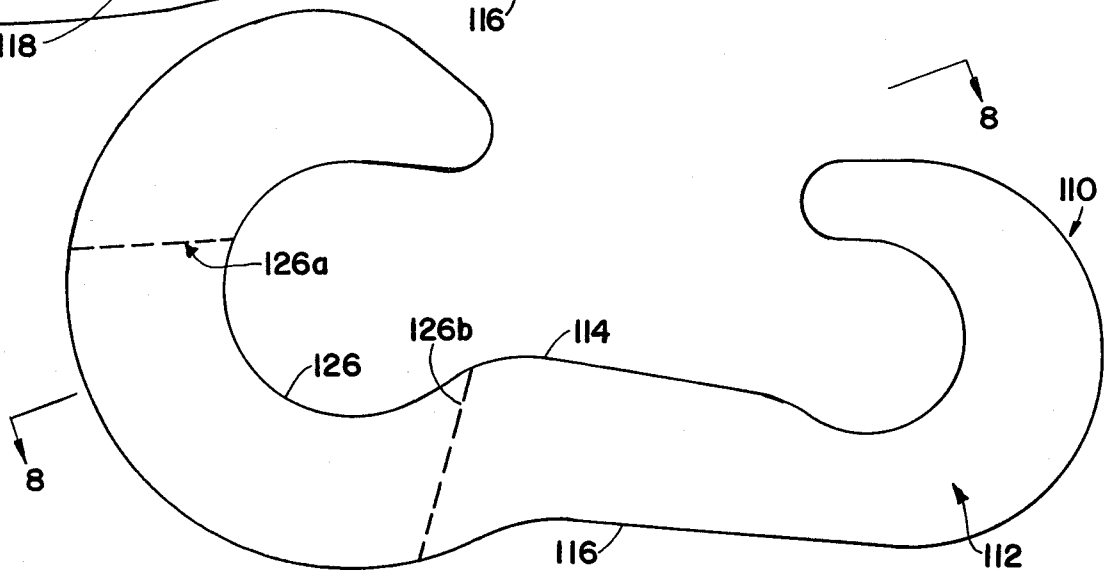
FIG. 6 is a top plan view of the traveller of FIG. 5, shown in identical dimensions and in a scale of 10:1.
Figure 7:
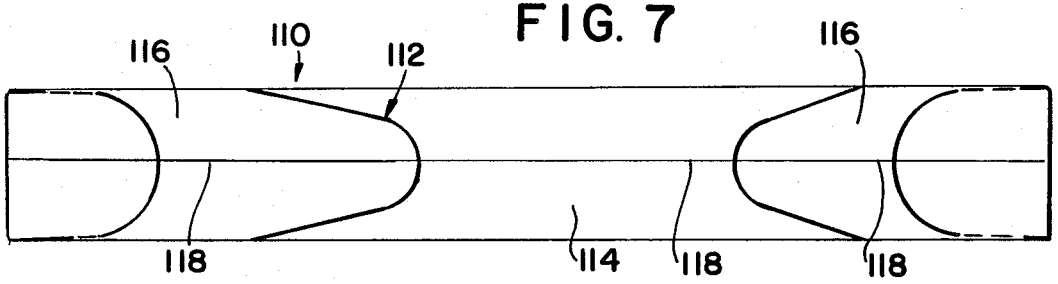
FIG. 7 is a side elevational view of the traveller of FIG. 6.

As shown in FIG. 2, traveller 10 slidably fits on a ring 20 of a textile spinning and twisting machine, ring 20 being positioned about a bobbin 22 on which yarn 24 is wrapped. Yarn 24 thereby extends about traveller 10, and particularly, about a portion of the inner surface 14 thereof constituting a yarn guide path 26, and then onto bobbin 22. During such time, traveller 10 rides about ring 20 so as to ensure that yarn 24 is wound properly about bobbin 22.

However, mold parting line 18, as shown best in FIG. 4, extends outerwardly to a point from planar inner surface 14. Accordingly, as yarn 24 rides thereover, mold parting line 18 caused by any mold mismatch or parting line flash, results in yarn 24 becoming fuzzy, as at 28, or breaking.

Referring now to FIGS. 5–8, a traveller 110 according to the present invention will now be described, in which elements corresponding to those described above with respect to the prior art of FIGS. 1–4 are identified by the same reference numerals augmented by 100, and a detailed description thereof will be omitted herein for the sake of brevity.

Figure 8:
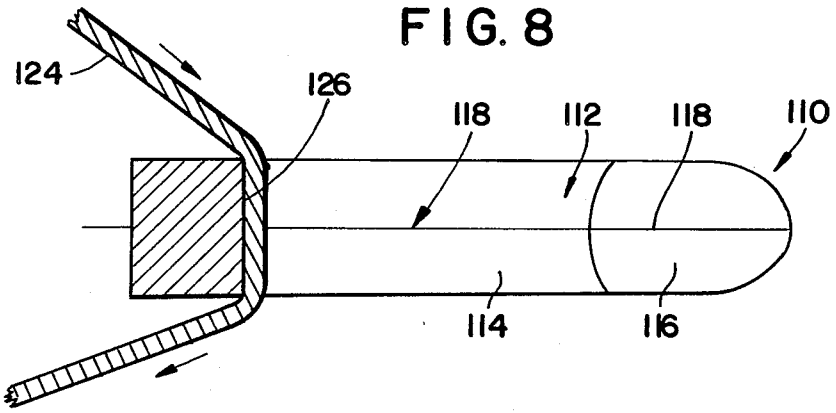
FIG. 8 is a cross-sectional view of the traveller of FIG. 6, taken along line 8—8 thereof, showing the smooth yarn guide path and yarn travelling thereover.

Specifically, traveller 110 differs from traveller 10 in that no parting line is formed on the inner surface 114 constituting yarn guide path 126 which is defined between lines 126*a* and 126*b*. . Thus, yarn guide path 126 at inner surface 114 presents a smooth surface for the yarn 124 travelling thereover, as best shown in FIG. 8, thereby avoiding problems of fuzzing yarn or breakage of the yarn.

Figure 11:
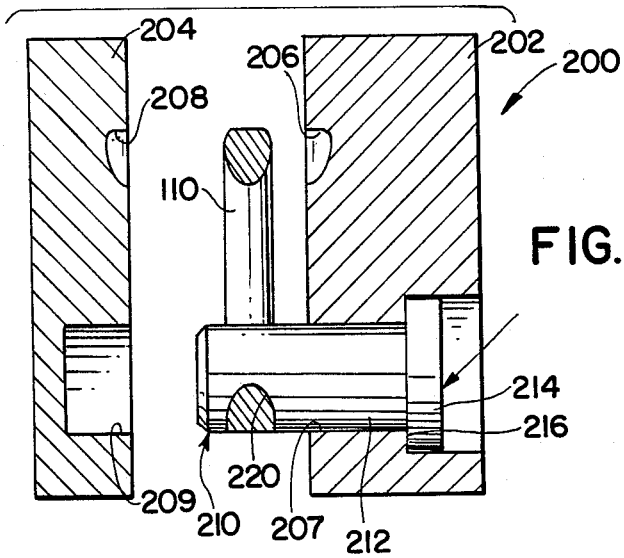
FIG. 11 is a cross-sectional view of the mold of FIG. 9, as shown in an open position after the traveller has been formed.
Figure 9:
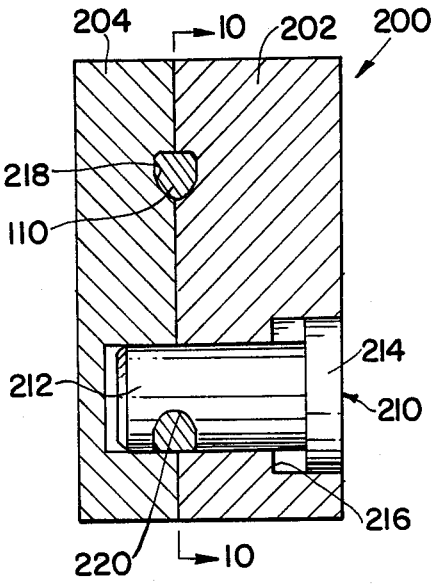
FIG. 9 is a cross-sectional view of a mold for forming the traveller of FIG. 5, the mold being in a closed position.
Figure 10:
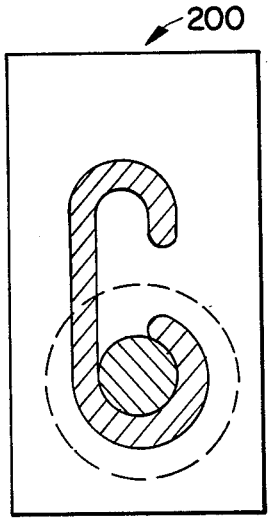
FIG. 10 is a cross-sectional view of the mold of FIG. 9, taken along line 9—9 thereof.

Referring now to FIGS. 9–11, a mold 200 for forming traveller 110 will now be described. Mold 200 is formed by a first mold half 202 and a second mold half 204 adapted to mate with each other. Specifically, the first mold half 202 includes a substantially C-shaped recess 206 and second mold half 204 likewise includes a substantially C-shaped recess 208. A lower portion 207 of recess 206 and a lower portion 209 of recess 208 are enlarged to receive an ejector pin 210. Specifically, ejector pin 210 includes a main shaft 212 and an enlarged head 214 at one end thereof and which abuts against a shoulder 216 in first mold half 202 to limit movement of ejector pin 210 within lower portions 207 and 209 of recesses 206 and 208 respectively.

When mold halves 202 and 204 are closed, shown in FIG. 9, recesses 206 and 208 form a substantially C-shaped cavity 208 for forming traveller 110. In addition, at such time, main shaft 212 of ejector pin 210 extends through lower portions 207 and 209 of recesses 206 and 208, respectively, so as to traverse and close the same. However, a groove 220 extends partially circumferentially about main shaft 212 and is contiguous with cavity 218 and thereby forms part of said cavity. In this regard, it is noted that groove 220 corresponds to yarn guide path 126 of traveller 110 that is to be formed in mold 200.

In this regard, a molding material is injected into cavity 218, in a conventional manner and is permitted to harden therein in the shape of traveller 110. Since groove 220 forms part of cavity 218, traveller 110 is formed in groove 220. Further, since groove 220 corresponds to the yarn guide path 126 of traveller 110, there is no mold parting line formed on yarn guide path 126.

After traveller 110 has been hardened and thereby formed, mold halves 202 and 204 are separated, as shown in FIG. 11. During such separation, since traveller 110 is formed about ejector pin 210, traveller 110 is removed from recess 208 of second mold half 204 when the mold halves are separated. Thereafter, ejector pin 210 is moved to the position shown in FIG. 11 that is, within lower portion 207 of C-shaped recess 206 so as to separate traveller 110 from recess 206 whereby traveller 110 falls from ejector pin 210 and can be carried away.

Therefore, traveller 110 is easily and economically formed within mold 200 according to the present invention such that yarn guide path 126 thereof is free from any mold parting line.

Having described specific preferred embodiments of the invention with reference to the accompanying drawings, it will be appreciated that the present invention is not limited to those precise embodiments and that various changes and modifications can be effected therein by one of ordinary skill in the art without departing from the spirit or scope of the invention as defined by the appended claims.

What is claimed is:

1. A molded traveller for use in a textile spinning and twisting machine comprising a substantially C-shaped molded member adapted to engage and travel about a ring of the machine said member having an outer molded surface and an inner molded surface, a portion of said inner surface constituting a molded yarn guide path on which yarn travels, and said molded yarn guide path on said inner molded surface being continuously smooth so as to be free of any mold parting line.

2. A traveller according to claim 1; wherein said yarn guide path is on an upper portion on said inner surface.

3. A mold for forming a traveller for use in a textile spinning and twisting machine, said traveller having an inner surface and a portion of said inner surface constituting a molded yarn guide path on which yarn travels, said mold comprising:

a first mold half having a first recess;

a second mold half having a second recess;

a mold cavity formed by said first and second recesses when said first and second mold halves are assembled together, said cavity having a substantially C-shape to form said traveller therein; and ejector means for forming said molded yarn guide path as a continuously smooth surface which is free of any parting line and for ejecting said traveller from said mold after said first and second mold halves have been opened.

4. A mold according to claim 3; wherein said ejector means includes an ejector pin movably mounted in said first mold through said first recess and engageable in said second recess once its first and second mold halves are assembled together. pin has a groove therein which is free of any parting line and about which the inner guide path on the inner surface of said traveller is formed such that said inner guide path is free of any mold parting line.

5. A mold according to claim 4; wherein said ejector pin has a groove therein which is free of any parting line at about which the inner guide path on the inner surface of said traveller is formed such that said inner guide path is continuously smooth so as to be free of any mold parting line.

* * * * *